US010703542B2

(12) United States Patent
Moribayashi

(10) Patent No.: US 10,703,542 B2
(45) Date of Patent: Jul. 7, 2020

(54) PACKAGING BAG AND METHOD OF USING PACKING STRUCTURE

(71) Applicant: JVC KENWOOD Corporation, Yokohama-shi, Kanagawa (JP)

(72) Inventor: Takeshi Moribayashi, Yokohama (JP)

(73) Assignee: JVCKENWOOD Corporation, Yokohama-shi, Kanagawa (JP)

( * ) Notice: Subject to any disclaimer, the term of this patent is extended or adjusted under 35 U.S.C. 154(b) by 0 days.

(21) Appl. No.: 16/164,491

(22) Filed: Oct. 18, 2018

(65) Prior Publication Data

US 2019/0127118 A1 May 2, 2019

(30) Foreign Application Priority Data

Oct. 30, 2017 (JP) ..... 2017-209313

(51) Int. Cl.

| | |
|---|---|
| ***B65D 33/00*** | (2006.01) |
| ***B65D 33/25*** | (2006.01) |
| ***B65D 75/54*** | (2006.01) |
| ***B65D 30/22*** | (2006.01) |

(52) U.S. Cl.

CPC ..... *B65D 33/2508* (2013.01); *B65D 31/12* (2013.01); *B65D 33/008* (2013.01); *B65D 75/545* (2013.01); *B65D 2313/00* (2013.01)

(58) Field of Classification Search

CPC .. B65D 33/2508; B65D 33/008; B65D 31/12; B65D 75/545; B65D 2313/00

USPC ..... 383/63

See application file for complete search history.

(56) References Cited

U.S. PATENT DOCUMENTS

| | | | | |
|---|---|---|---|---|
| 4,046,408 | A * | 9/1977 | Ausnit | B29C 65/58 285/188 |
| 4,635,294 | A * | 1/1987 | Bentsen | B65D 33/2508 383/37 |
| 4,756,628 | A * | 7/1988 | Branson | B29C 66/1122 383/120 |
| 4,927,405 | A * | 5/1990 | Martin | B65D 31/12 206/569 |
| 4,993,844 | A * | 2/1991 | Robinson | B65D 31/12 383/38 |
| 5,018,876 | A * | 5/1991 | Mennella | B65F 1/0053 220/909 |
| RE34,117 | E * | 10/1992 | Martin | B29C 66/004 493/194 |
| 5,246,119 | A * | 9/1993 | Heffner | B07C 7/04 209/702 |
| 6,234,675 | B1 * | 5/2001 | Saad | B65D 31/12 383/102 |
| 6,579,008 | B2 * | 6/2003 | Price | B65D 31/12 383/35 |
| 2005/0196076 | A1 * | 9/2005 | Tanaka | B65D 33/007 383/63 |

(Continued)

FOREIGN PATENT DOCUMENTS

JP H6-286759 A 10/1994

*Primary Examiner* — Peter N Helvey

(74) *Attorney, Agent, or Firm* — Procopio, Cory, Hargreaves & Savitch LLP

(57) ABSTRACT

A large packaging bag includes a packaging bag body. The packaging bag body has a bag opening. The large packaging bag also includes an exposed zipper profile part. The exposed zipper profile part has a female engaging surface. The engaging surface is exposed outside when the bag opening is closed.

4 Claims, 12 Drawing Sheets

(56) References Cited

U.S. PATENT DOCUMENTS

2007/0189639 A1* 8/2007 Revness ..... B65F 1/0006
383/37

* cited by examiner

PACKAGING BAG AND METHOD OF USING PACKING STRUCTURE

CROSS REFERENCE TO RELATED APPLICATION

This application is based upon and claims the benefit of priority from Japanese patent application No. 2017-209313, filed on Oct. 30, 2017, the disclosure of which is incorporated herein in its entirety by reference.

BACKGROUND

The present invention relates to a packaging bag and a method of using a packing structure.

Japanese Unexamined Patent Application Publication No. H6-286759 discloses a reclosable zipper bag with male and female engaging zipper profiles made of synthetic resin placed on an inner surface of a bag opening.

When packaging a product in the field of car navigation devices, an instruction manual and an SD memory card (registered trademark) in which map data is stored are packed into different packaging bags in general. This is because there is a possibility that a new version of map data is released after a product is shipped and before it is sold to an end consumer, and in such a case it is necessary to replace the SD memory card in the product with another SD memory card in which the new version of map data is stored, or rewrite the map data in the SD memory card in the product.

Further, because a packaging bag for packing an SD memory card (which is referred to hereinafter as SD packaging bag) is smaller than a packaging bag for packing an instruction manual (instruction manual packaging bag), it has been considered preferable to attach the SD packaging bag on a certain part of the instruction manual packaging bag by a tape in order to prevent the SD packaging bag from getting lost in a packaging box.

SUMMARY

However, the attaching the SD packaging bag onto the instruction manual packaging bag by a tape has the following problem. When a new version of map data is released, it is necessary to peel the tape off the instruction manual packaging bag and take the SD memory card out of the SD packaging bag in order to replace the SD memory card or rewrite the map data in the SD memory card, and this can damage the instruction manual packaging bag, which causes the need for replacement of the instruction manual packaging bag or the degradation of the appearance of the instruction manual packaging bag.

According to a first aspect of the embodiment, there is provided a packaging bag including a packaging bag body having a bag opening, and an exposed zipper profile part having a male or female engaging surface, the engaging surface being exposed outside when the bag opening is closed.

According to a second aspect of the embodiment, there is provided a method of using a packing structure including a step of preparing two packaging bags, each including a packaging bag body having a bag opening and an exposed zipper profile part having a male or female engaging surface, the engaging surface being exposed outside when the bag opening is closed, and a step of joining the two packaging bags by engaging the exposed zipper profile parts with each other.

BRIEF DESCRIPTION OF THE DRAWINGS

The above and other aspects, advantages and features will be more apparent from the following description of certain embodiments taken in conjunction with the accompanying drawings, in which.

DETAILED DESCRIPTION

First Embodiment

A first embodiment is described hereinafter with reference to FIGS. 1 to 6. In the following description of drawings, the same or similar parts are denoted by the same or similar reference symbols. It should be noted that the drawings are schematic, and the relationship between thickness and planar dimensions, the thickness ratio of each layer and the like may be different from actual ones. Therefore, specific thickness and dimensions should be determined in consideration of the following description. Further, dimensional relationships and ratios may vary from drawing to drawing.

Further, the below-described embodiments show a structure and a method for implementing the technical idea of the present invention by way of illustration only, and the technical idea of the present invention does not limit the material, shape, structure, arrangement or the like of the elements to those described below. Various modifications may be made to the technical idea of the present invention within the spirit and scope of the appended claims.

Packing Structure 1

Figure 1:
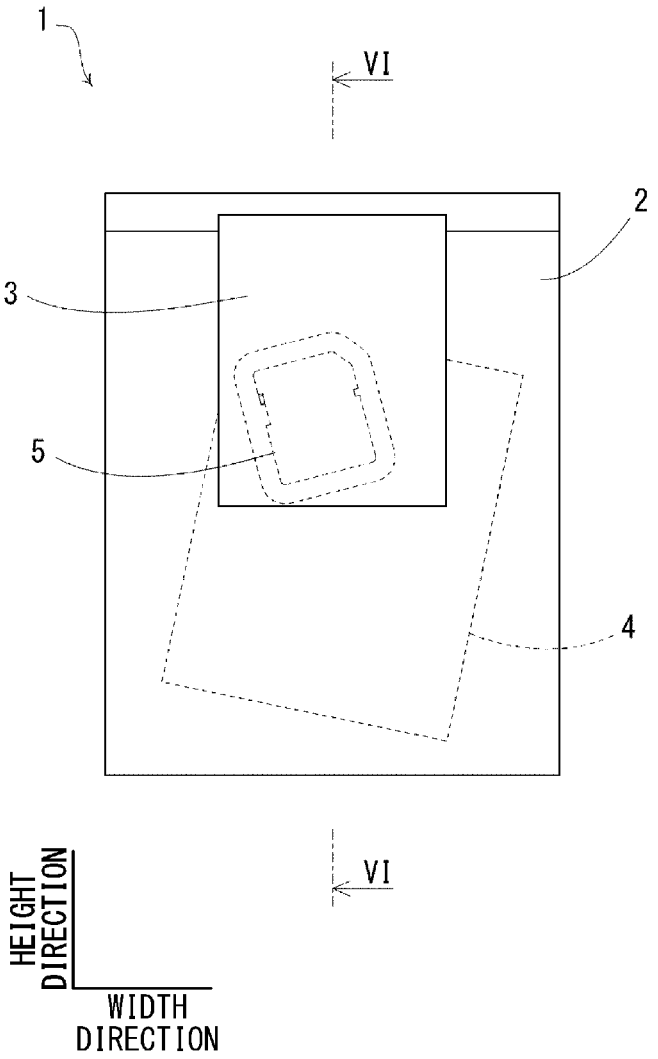
FIG. 1 is a front view of a packing structure (first embodiment)

FIG. 1 shows a front view of a packing structure 1. The packing structure 1 is composed of a large packaging bag 2, which is one specific example of a packaging bag, and a small packaging bag 3, which is one specific example of a packaging bag. The large packaging bag 2 is larger than the small packaging bag 3 in height and width.

An instruction manual 4 of a car navigation device, for example, is packed into the large packaging bag 2. The instruction manual 4 is one specific example of a large object to be packed. An SD memory card 5 in which map data to be used for a car navigation device, for example, is packed into the car navigation device. The SD memory card 5 is one specific example of a small object to be packed. Each of the instruction manual 4 and the SD memory card 5 is in the shape of a thin rectangular sheet. The instruction manual 4 is larger than the SD memory card 5 in height, width and thickness.

Large Packaging Bag 2

Figure 2:
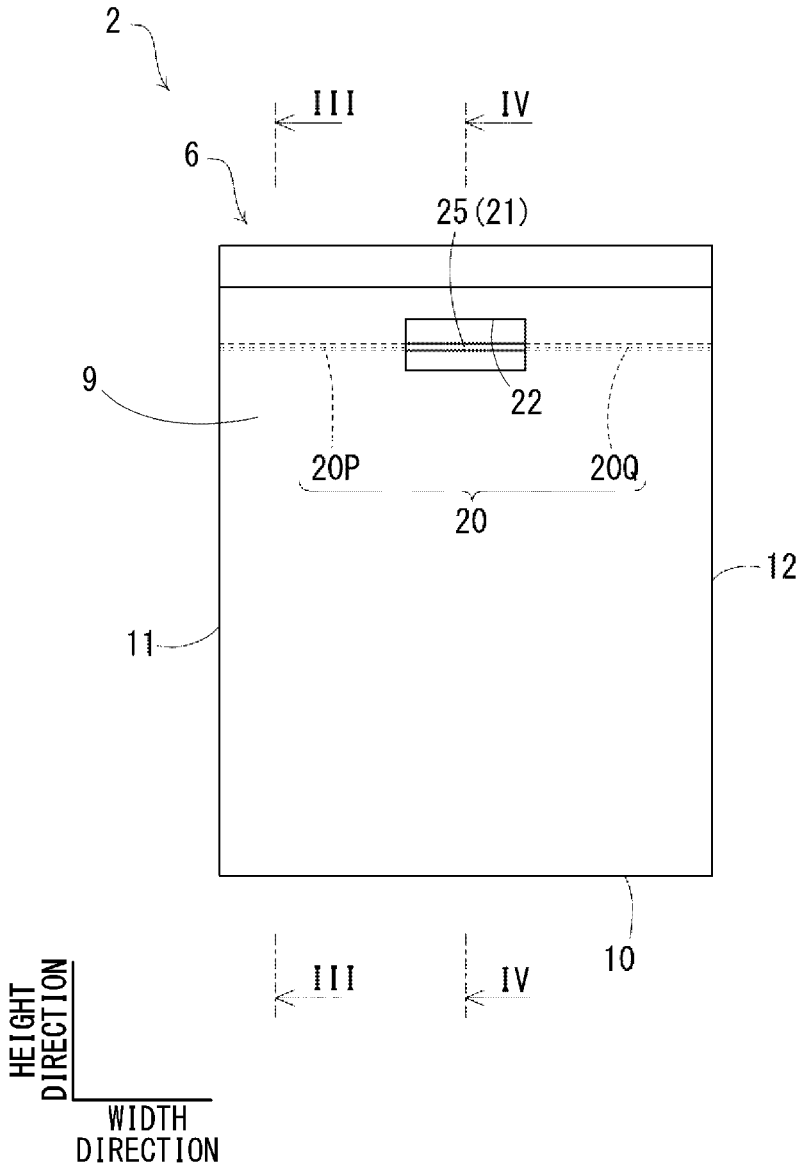
FIG. 2 is a front view of a large packaging bag (first embodiment)
Figure 3:
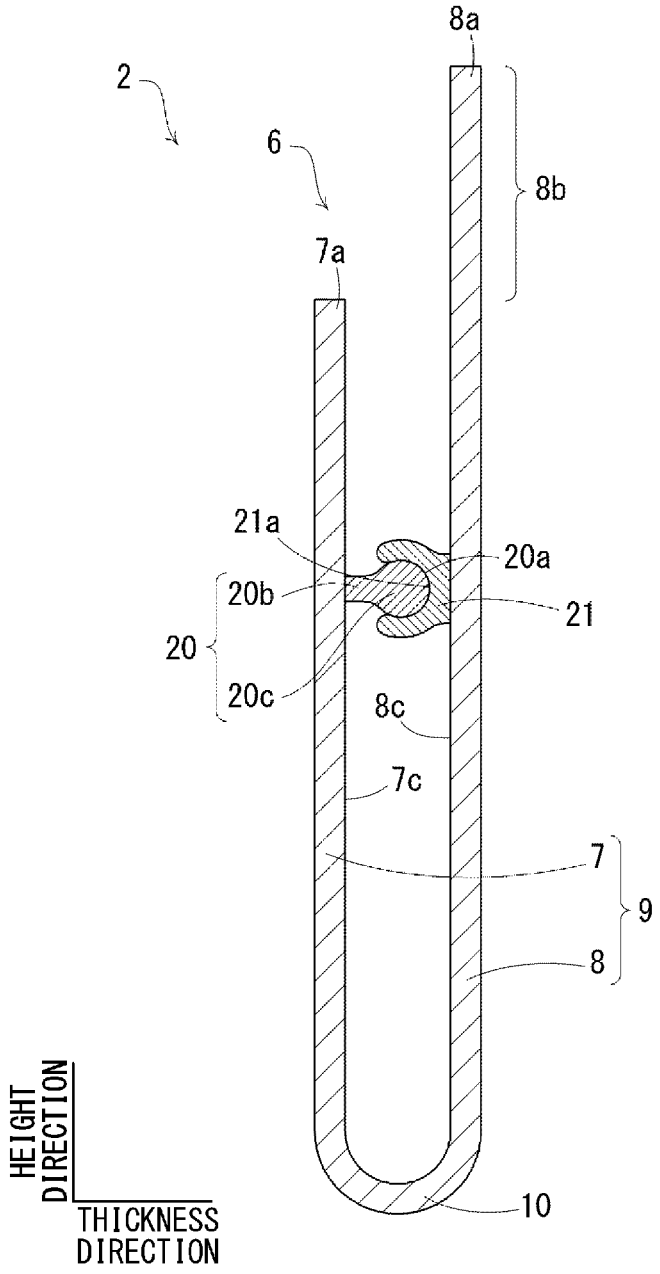
FIG. 3 is an end view along line III-III in FIG. 2 (first embodiment)
Figure 4:
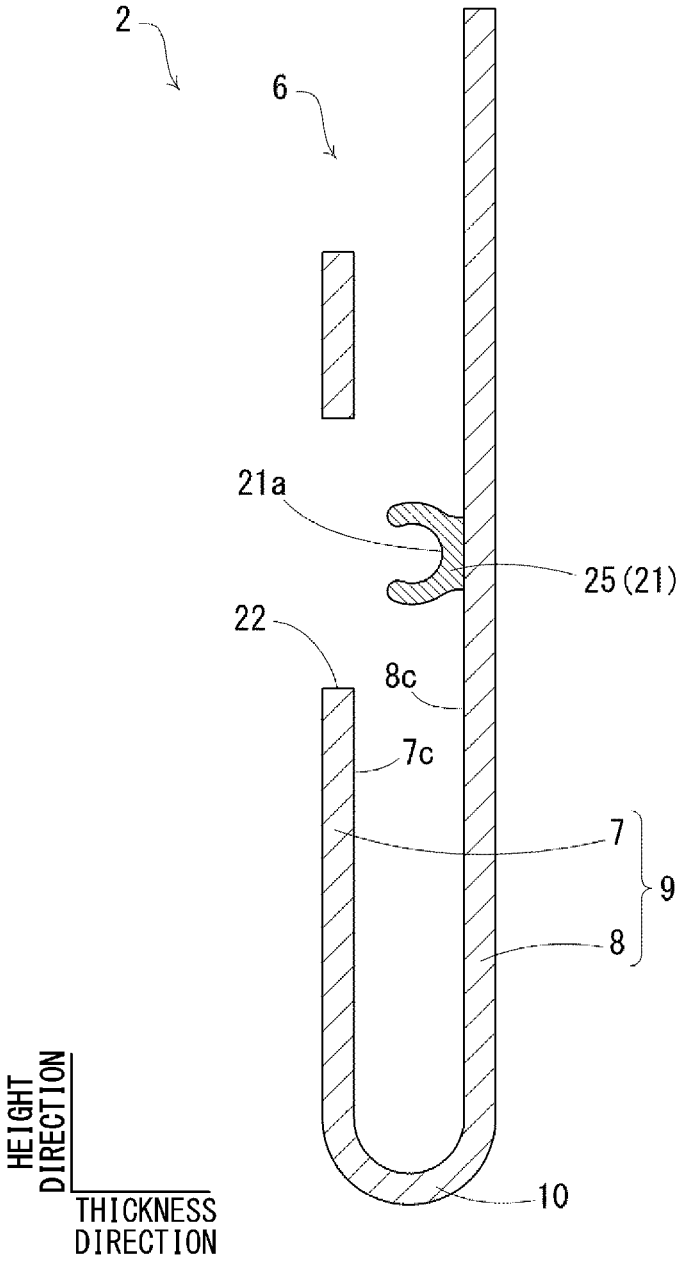
FIG. 4 is an end view along line IV-IV in FIG. 2 (first embodiment)

FIG. 2 shows a front view of the large packaging bag 2. FIG. 3 shows an end view along line III-III in FIG. 2. FIG. 4 shows an end view along line IV-IV in FIG. 2.

As shown in FIGS. 2 to 4, the large packaging bag 2 is formed into a bag shape by folding a transparent resin sheet such as polyethylene, polypropylene or polyethylene terephthalate and welding the left and right sides, for example. The large packaging bag 2 has a bag opening 6 that opens upward.

Front Sheet Part 7 and Rear Sheet Part 8

As shown in FIG. 3, the large packaging bag 2 has a front sheet part 7 and a rear sheet part 8. The front sheet part 7 and the rear sheet part 8 constitute a packaging bag body 9 of the large packaging bag 2. The front sheet part 7 and the rear sheet part 8 are opposite to each other in the thickness direction of the packaging bag body 9. Hereinafter, "the thickness direction of the packaging bag body 9" is referred to simply as "the thickness direction", "the width direction of the packaging bag body 9" is referred to simply as "the width direction", and "the height direction of the packaging bag body 9" is referred to simply as "the height direction".

The front sheet part 7 and the rear sheet part 8 are connected through a folded part 10 at the lower end of the large packaging bag 2. The front sheet part 7 and the rear sheet part 8 may be connected by welding at the lower end of the large packaging bag 2. The front sheet part 7 has an upper end 7*a*. The rear sheet part 8 has an upper end 8*a*. The rear sheet part 8 extends more upward than the upper end 7*a* of the front sheet part 7. In other words, the upper end 8*a* of the rear sheet part 8 is located upper than the upper end 7*a* of the front sheet part 7. To be specific, the rear sheet part 8 has an upper extension 8*b*, which is a part that extends more upward than the upper end 7*a* of the front sheet part 7. Referring back to FIG. 2, the large packaging bag 2 has a left side welded part 11 where the front sheet part 7 and the rear sheet part 8 are welded together on the left side, and a right side welded part 12 where the front sheet part 7 and the rear sheet part 8 are welded together on the right side.

Male Zipper Profile Part 20, Female Zipper Profile Part 21

As shown in FIG. 3, a male zipper profile part 20 and a female zipper profile part 21 are disposed opposite to each other on the inner surface of the bag opening 6 of the large packaging bag 2. By engaging the male zipper profile part 20 and the female zipper profile part 21 with each other, the bag opening 6 closes.

Specifically, the front sheet part 7 has an inner surface 7*c* that faces the rear sheet part 8. Likewise, the rear sheet part 8 has an inner surface 8*c* that faces the front sheet part 7.

The male zipper profile part 20 is formed near the bag opening 6 on the inner surface 7*c* of the front sheet part 7. The male zipper profile part 20 is formed to project from the inner surface 7*c* of the front sheet part 7 toward the rear sheet part 8. The male zipper profile part 20 is formed along the width direction.

The male zipper profile part 20 has a male engaging surface 20*a*. The male zipper profile part 20 has a thin part 20*b* and a thick part 20*c* which is larger than the thin part 20*b* in height. In other words, the cross-sectional shape of the male zipper profile part 20 gets thicker as it goes from the front sheet part 7 toward the rear sheet part 8.

As shown in FIG. 2, the male zipper profile part 20 is composed of a left side male zipper profile part 20P and a right side male zipper profile part 20Q. The left side male zipper profile part 20P and the right side male zipper profile part 20Q are separated from each other in the width direction. In other words, the male zipper profile part 20 has a gap at the center in the width direction. The male zipper profile part 20 is absent at the center in the width direction.

As shown in FIG. 3, the female zipper profile part 21 is formed near the bag opening 6 on the inner surface 8*c* of the rear sheet part 8. The female zipper profile part 21 is formed to project from the inner surface 8*c* of the rear sheet part 8 toward the front sheet part 7. The female zipper profile part 21 is formed along the width direction.

The female zipper profile part 21 has a female engaging surface 21*a*. In other words, the female zipper profile part 21 is formed in a substantially 2 shape that branches into two parts as it goes from the rear sheet part 8 toward the front sheet part 7.

As shown in FIG. 2, the female zipper profile part 21 is formed to be continuous from the left side welded part 11 to the right side welded part 12 of the large packaging bag 2.

Exposed Zipper Profile Part 25

As shown in FIGS. 2 and 4, the front sheet part 7 has a rectangular opening 22. The opening 22 is near the bag opening 6. The opening 22 is at the center in the width direction. The opening 22 is at the position overlapping the female zipper profile part 21 in the thickness direction. As shown in FIG. 2, the opening 22 is between the left side male zipper profile part 20P and the right side male zipper profile part 20Q in the width direction. Thus, when the bag opening 6 is closed, a part of the female zipper profile part 21 which overlaps the opening 22 in the thickness direction is exposed outside. This part of the female zipper profile part 21 which is not covered with the front sheet part 7 in the thickness direction is hereinafter referred to as an exposed zipper profile part 25. In this embodiment, the exposed zipper profile part 25 is a part of the female zipper profile part 21. The male zipper profile part 20 is formed not to overlap the exposed zipper profile part 25 in the thickness direction. The opening 22 exists in a part of the front sheet part 7 which faces the exposed zipper profile part 25 in the thickness direction. As shown in FIG. 4, the engaging surface 21*a* of the exposed zipper profile part 25 is exposed outside without being covered with the front sheet part 7 in the thickness direction when the bag opening 6 is closed. Stated differently, the engaging surface 21*a* of the exposed zipper profile part 25 can be touched with a finger when the bag opening 6 is closed.

Small Packaging Bag 3

Figure 5:
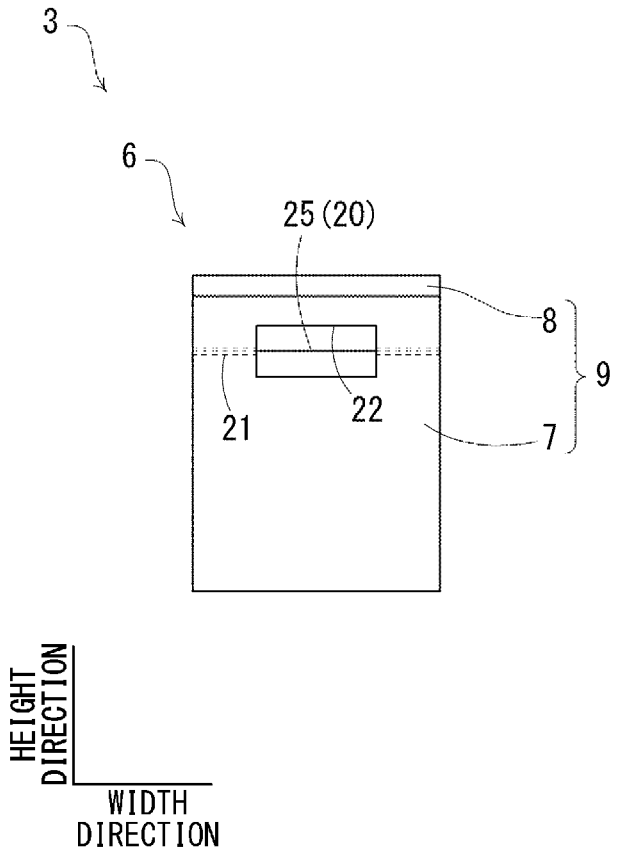
FIG. 5 is a front view of a small packaging bag (first embodiment)

The small packaging bag 3 is described hereinafter with reference to FIG. 5. FIG. 5 shows a front view of the small packaging bag 3. The small packaging bag 3 has the same structure as the large packaging bag 2 except for height and width dimensions. Note that, however, in the small packaging bag 3, the female zipper profile part 21 is formed on the front sheet part 7, and the male zipper profile part 20 is formed on the rear sheet part 8. Thus, the exposed zipper profile part 25 is a part of the male zipper profile part 20.

Method of Using Packing Structure 1

Figure 6:
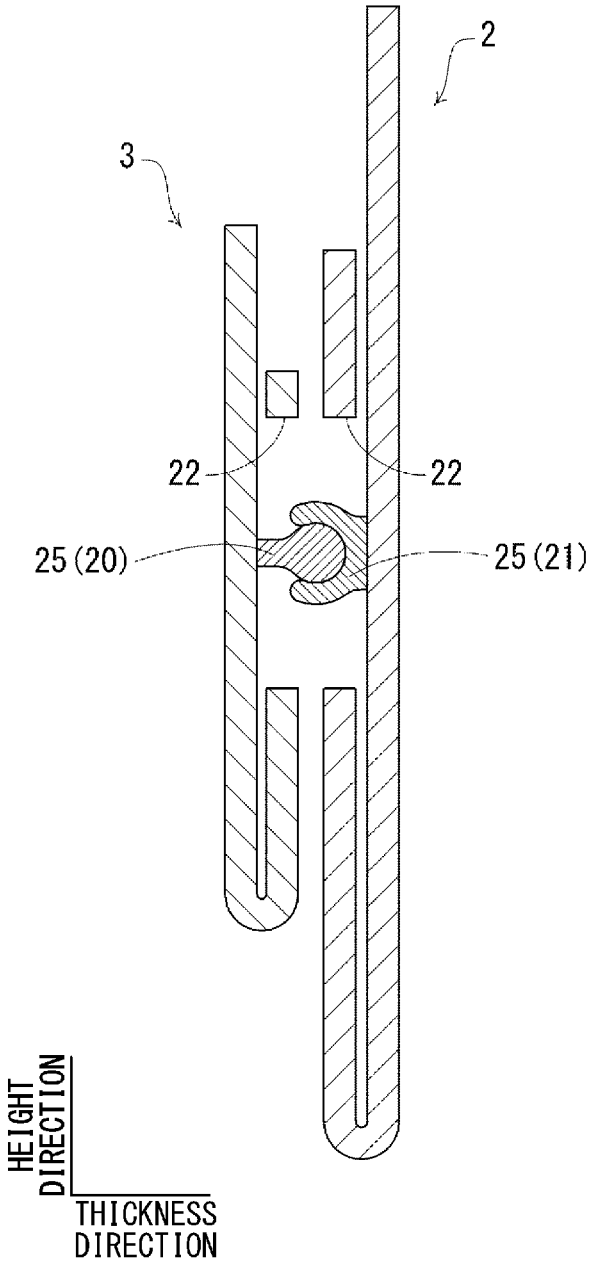
FIG. 6 is an end view along line VI-VI in FIG. 1 (first embodiment)

A method of using the packing structure 1 is described hereinafter with reference to FIG. 6. FIG. 6 shows an end view along line VI-VI in FIG. 1. Note that, however, the illustration of the instruction manual 4 that is packed in the large packaging bag 2 and the SD memory card 5 that is packed in the small packaging bag 3 is omitted.

As shown in FIG. 6, the packing structure 1 can be assembled by engaging the exposed zipper profile part 25 of the large packaging bag 2 and the exposed zipper profile part 25 of the small packaging bag 3 with each other and thereby joining the large packaging bag 2 and the small packaging bag 3 together.

In an actual use, when map data is updated, an operator first pulls the exposed zipper profile part 25 of the small packaging bag 3 out of the exposed zipper profile part 25 of the large packaging bag 2 and thereby detaches the small packaging bag 3 from the large packaging bag 2.

Next, the operator takes the SD memory card 5 out of the small packaging bag 3, and rewrites the map data stored in the SD memory card 5 or replaces it with the SD memory card 5 in which new map data is stored. Then, the operator packs the written or new SD memory card 5 into the small packaging bag 3, and closes the bag opening 6 of the small packaging bag 3.

After that, the operator engages the exposed zipper profile part 25 of the large packaging bag 2 and the exposed zipper profile part 25 of the small packaging bag 3 with each other, thereby joining the large packaging bag 2 and the small packaging bag 3 again.

In this manner, by using the exposed zipper profile part 25 of the large packaging bag 2 and the exposed zipper profile part 25 of the small packaging bag 3, it is possible to easily attach and detach the large packaging bag 2 and the small packaging bag 3. When the small packaging bag 3 is attached onto the large packaging bag 2 by using an adhesive tape or the like, for example, it is necessary to peel the adhesive tape off the large packaging bag 2, which can damage the large packaging bag 2. Therefore, the above-described way of attaching and detaching the large packaging bag 2 and the small packaging bag 3 with use of the exposed zipper profile part 25 of the large packaging bag 2 and the exposed zipper profile part 25 of the small packaging bag 3 also has the effect of avoiding the damage of the large packaging bag 2.

The first embodiment is described above. The above-described first embodiment has the following features.

Specifically, as shown in FIGS. 3 and 4, the large packaging bag 2 (packaging bag) includes the packaging bag body 9 having the bag opening 6 and the exposed zipper profile part 25 having the female engaging surface 21*a*, where the engaging surface 21*a* is exposed outside when the bag opening 6 is closed. In this structure, it is possible to avoid the damage of the large packaging bag 2 even when another item is attached to and detached from the large packaging bag 2.

Further, as shown in FIG. 3, the male zipper profile part 20 having the male engaging surface 20*a* and the female zipper profile part 21 having the female engaging surface 21*a* are disposed opposite to each other respectively on the inner surface 7*c* and the inner surface 8*c* of the bag opening 6 of the packaging bag body 9. The bag opening 6 closes by engaging the male zipper profile part 20 and the female zipper profile part 21 with each other. As shown in FIGS. 2 and 4, the exposed zipper profile part 25 is a part of the female zipper profile part 21. In this structure, there is no need to additionally form the male zipper profile part 20 and the female zipper profile part 21, and it is thereby possible to reduce additional costs when forming the exposed zipper profile part 25.

Further, as shown in FIG. 2, the male zipper profile part 20 is formed not to overlap the exposed zipper profile part 25 in the thickness direction of the packaging bag body 9. The opening 22 exists in a part of the packaging bag body 9 which is opposite to the exposed zipper profile part 25 in the thickness direction of the packaging bag body 9. In this structure, it is possible to use a part of the female zipper profile part 21 as the exposed zipper profile part 25 in a simple structure.

Further, as shown in FIG. 6, a method of using the packing structure 1 includes a step of joining the large packaging bag 2 that includes the packaging bag body 9 having the bag opening 6 and the exposed zipper profile part 25 having a male or female engaging surface, where the engaging surface is exposed outside when the bag opening 6 is closed, and the small packaging bag 3 by engaging their exposed zipper profile parts 25 with each other. In this method, it is possible to join the large packaging bag 2 and the small packaging bag 3 together in a very simple operation.

The above-described first embodiment can be modified as follows.

Specifically, because the male zipper profile part 20 and the female zipper profile part 21 are complementary to each other in the above-described first embodiment, the following embodiments and modified examples, the male zipper profile part 20 (and the engaging surface 20*a*) may be replaced with the female zipper profile part 21 (and the engaging surface 21*a*), and the female zipper profile part 21 (and the engaging surface 21*a*) may be replaced with the male zipper profile part 20 (and the engaging surface 20*a*).

Figure 7:
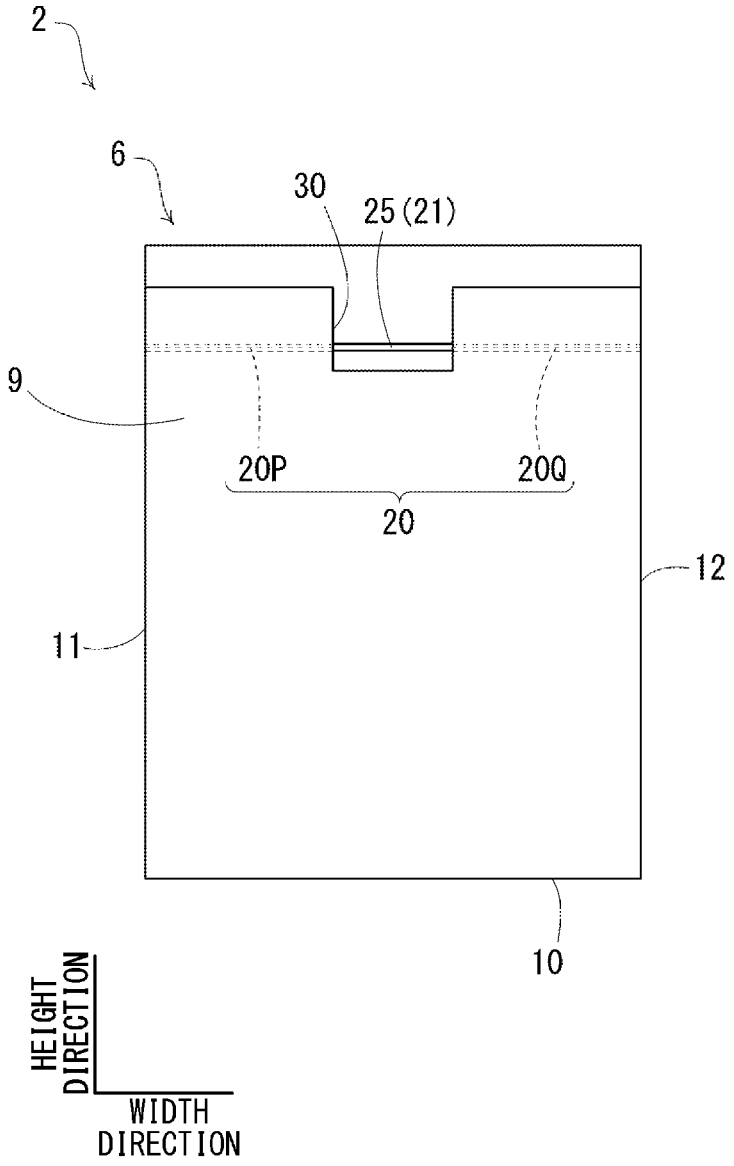
FIG. 7 is a view showing a modified example of the first embodiment.

Further, in the above-described first embodiment, the packaging bag body 9 has the opening 22 for the exposed zipper profile part 25 to be exposed outside as shown in FIGS. 2 and 4. Instead of this, the packaging bag body 9 may have a cutout 30 for the exposed zipper profile part 25 to be exposed outside as shown in FIG. 7.

Second Embodiment

Figure 8:
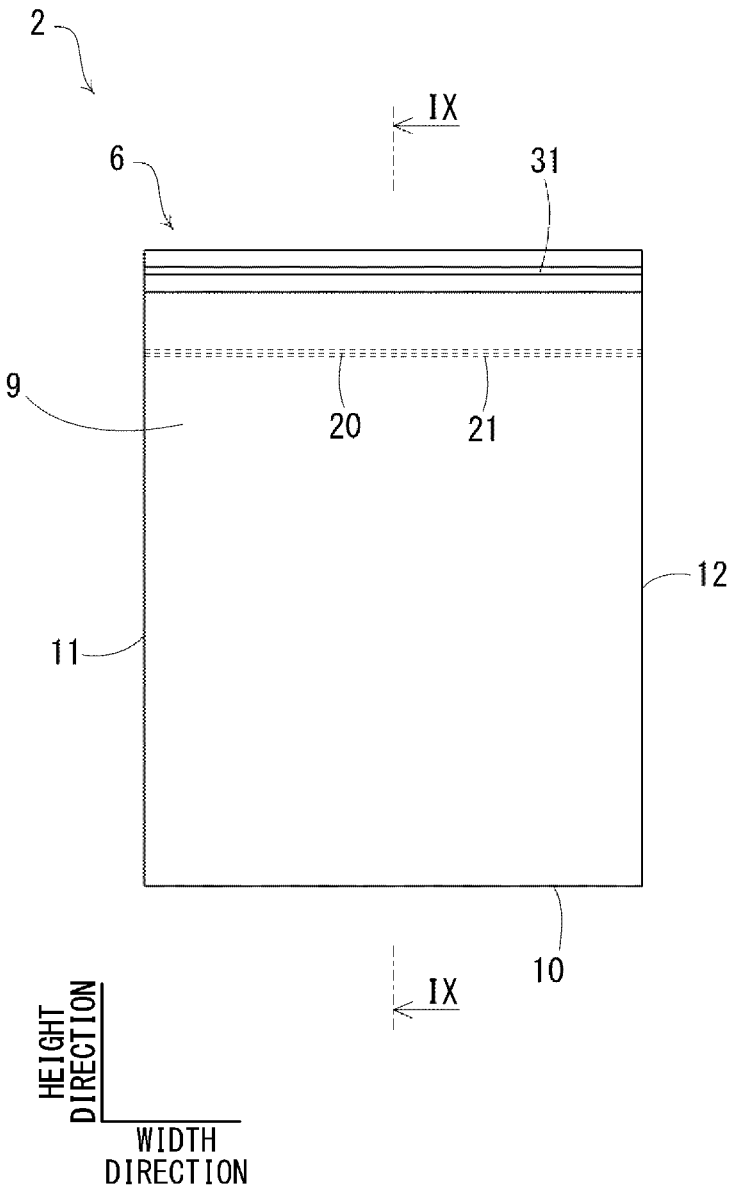
FIG. 8 is a front view of a large packaging bag (second embodiment)
Figure 9:
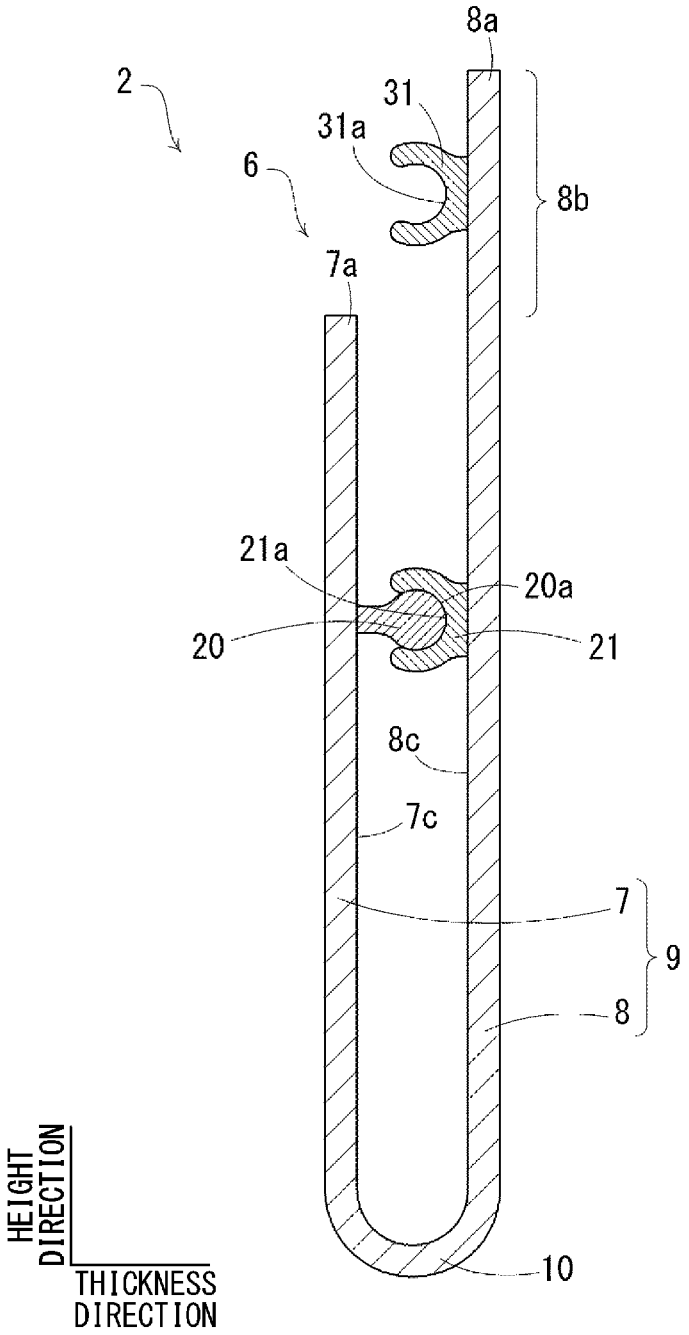
FIG. 9 is an end view along line IX-IX in FIG. 8 (second embodiment)

A second embodiment is described hereinafter with reference to FIGS. 8 and 9. FIG. 8 is a front view of a large packaging bag. FIG. 9 is an end view along line IX-IX in FIG. 8. Differences of this embodiment from the above-described first embodiment are mainly described below, and redundant description is omitted.

In the above-described first embodiment, the front sheet part 7 of the packaging bag body 9 has the opening 22, so that a part of the female zipper profile part 21 serves as the exposed zipper profile part 25, as shown in FIGS. 2 and 4.

On the other hand, in this embodiment, the front sheet part 7 of the packaging bag body 9 does not have the opening 22, and the male zipper profile part 20 extends continuously from the left side welded part 11 to the right side welded part 12 as shown in FIGS. 8 and 9. Accordingly, the male zipper profile part 20 and the female zipper profile part 21 engage with each other continuously from the left side welded part 11 to the right side welded part 12.

Further, in this embodiment, a female zipper profile part 31 having a female engaging surface 31*a* is formed on the inner surface 8*c* of the upper extension 8*b* of the rear sheet part 8. The female zipper profile part 31 is one specific example of the exposed zipper profile part. The female zipper profile part 31 that is formed on the inner surface 8*c* of the upper extension 8*b* of the rear sheet part 8 is not covered with the front sheet part 7 in the thickness direction, and therefore it is exposed outside when the bag opening 6 is closed. In this structure, because the male zipper profile part 20 and the female zipper profile part 21 engage with each other continuously from the left side welded part 11 to the right side welded part 12, it is possible to close the bag opening 6 more tightly than in the above-described first embodiment. Further, because the female zipper profile part 21 and the female zipper profile part 31 are formed on the same inner surface 8c, it is possible to form the female zipper profile part 31 at low costs, and it is thereby possible to reduce the costs of the large packaging bag 2.

The second embodiment is described above. The above-described second embodiment has the following features.

The packaging bag body 9 includes the front sheet part 7 as a first resin sheet part on which the male zipper profile part 20 having the male engaging surface 20a is formed and the rear sheet part 8 as a second resin sheet part on which the female zipper profile part 21 having the female engaging surface 21a is formed. The bag opening 6 closes by engaging the male zipper profile part 20 and the female zipper profile part 21 with each other. The rear sheet part 8 extends more upward than the upper end 7a of the front sheet part 7, and the female zipper profile part 31 that serves as the exposed zipper profile part is formed on this extended part, which is the upper extension 8b. In this structure, one specific example of the placement of the female zipper profile part 31 that serves as the exposed zipper profile part is provided.

Further, the female zipper profile part 31 that serves as the exposed zipper profile part is formed on the same surface as the inner surface 8c on which the female zipper profile part 21 is formed. In this structure, it is possible to form the female zipper profile part 31 at low costs, and it is thereby possible to reduce the costs of the large packaging bag 2.

Note that, in the above-described second embodiment, the rear sheet part 8 extends more upward than the upper end 7a of the front sheet part 7, and the female zipper profile part 31 is placed on this extended part, which is the upper extension 8b. Alternatively, the front sheet part 7 may extend more upward than the upper end 8a of the rear sheet part 8, and the female zipper profile part 31 may be placed on this extended part. Further, as described earlier, the male zipper profile part, instead of the female zipper profile part 31, may be formed as the exposed zipper profile part.

Third Embodiment

Figure 10:
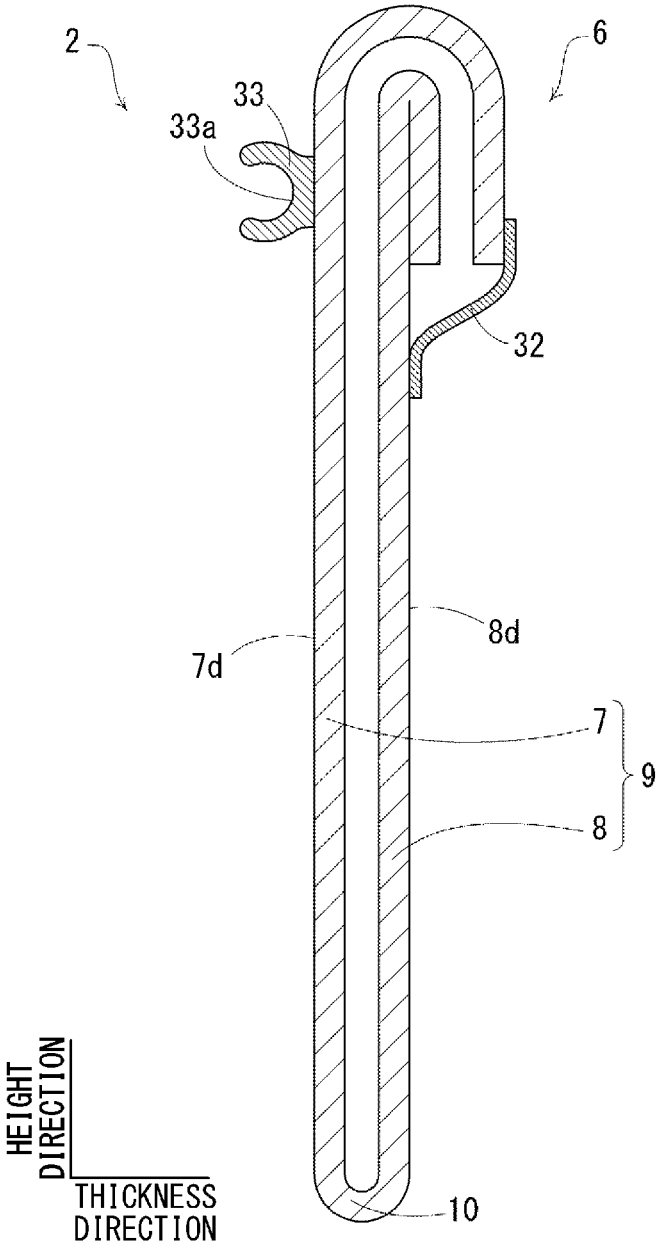
FIG. 10 is an end view of a large packaging bag (third embodiment)

A third embodiment is described hereinafter with reference to FIG. 10. FIG. 10 is an end view of a large packaging bag. Differences of this embodiment from the above-described first embodiment are mainly described below, and redundant description is omitted.

In the above-described first embodiment, the male zipper profile part 20 is formed on the inner surface 7c of the front sheet part 7, the female zipper profile part 21 is formed on the inner surface 8c of the rear sheet part 8, and the male zipper profile part 20 and the female zipper profile part 21 engage with each other to thereby close the bag opening 6 as shown in FIG. 3, for example.

On the other hand, in this embodiment, the male zipper profile part 20 and the female zipper profile part 21 are omitted, and the bag opening 6 closes by folding back the upper part of the packaging bag body 9 and fastening it with an adhesive tape 32 as shown in FIG. 10. Further, a female zipper profile part 33 having a female engaging surface 33a is formed on an outer surface 7d of the front sheet part 7. The female zipper profile part 33 is one specific example of the exposed zipper profile part. The engaging surface 33a of the female zipper profile part 33 is not covered with the front sheet part 7 in the thickness direction and thus exposed outside.

Note that, the female zipper profile part 33 that serves as the exposed zipper profile part may be formed on an outer surface 8d of the rear sheet part 8 of the packaging bag body 9, rather than on the outer surface 7d of the front sheet part 7 of the packaging bag body 9.

According to each of the embodiments described above, it is possible to avoid the damage of a packaging bag even when another item is attached to and detached from the packaging bag.

The first to third embodiments can be combined as desirable by one of ordinary skill in the art.

Reference Embodiment

Figure 11:
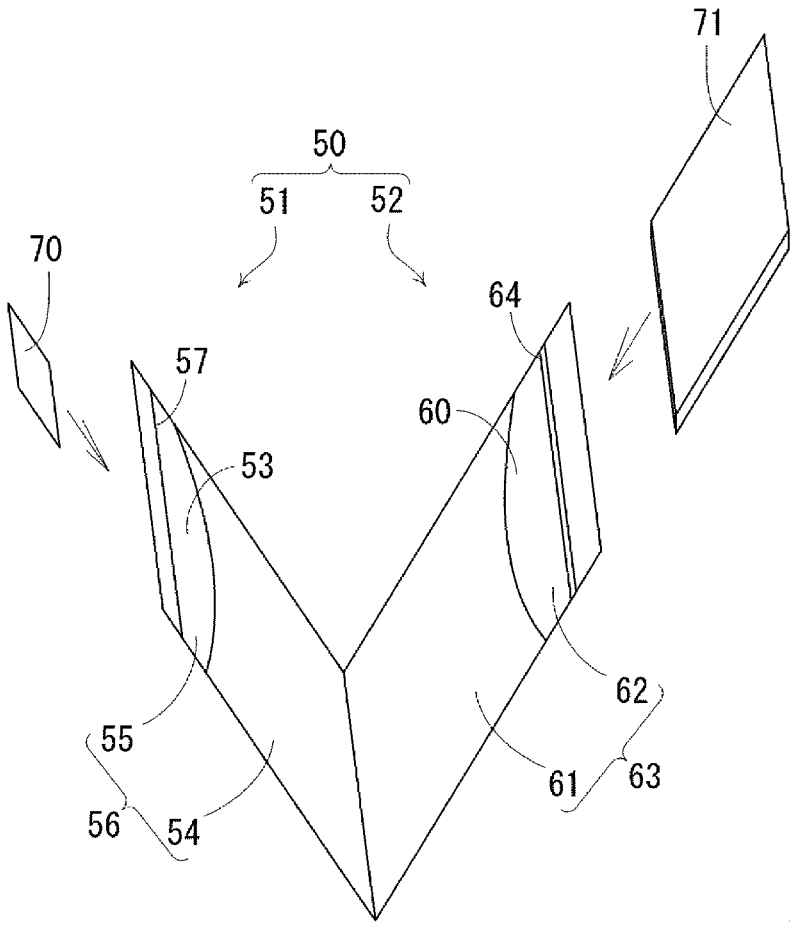
FIG. 11 is a perspective view of a packing structure according to a reference embodiment.
Figure 12:
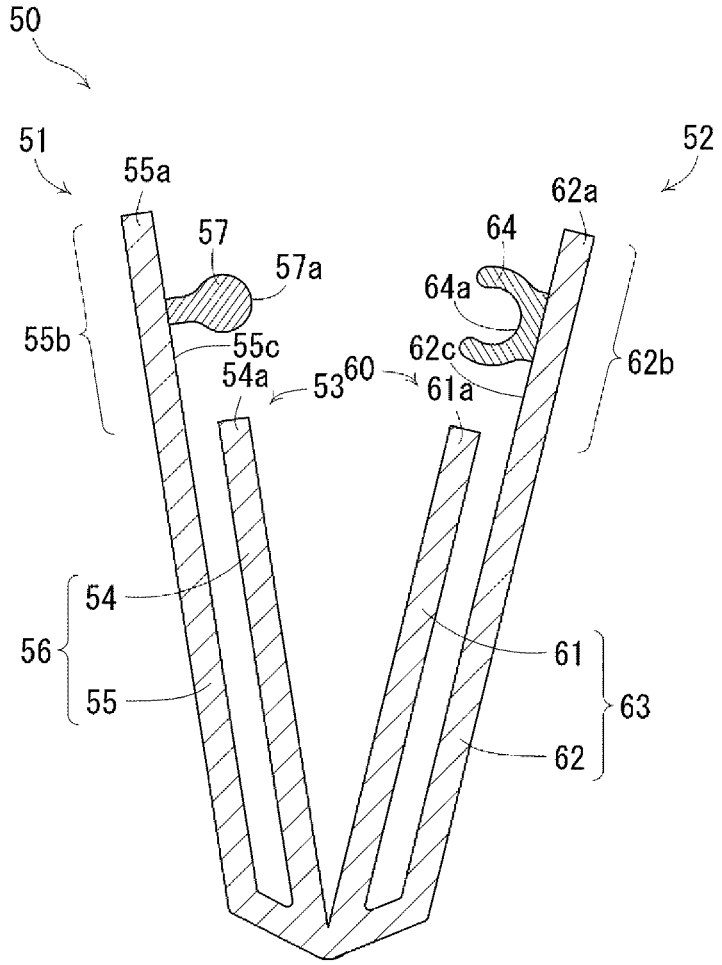
FIG. 12 is an end view of a packing structure according to a reference embodiment.

A reference embodiment is described hereinafter with reference to FIGS. 11 and 12. FIG. 11 is a perspective view of a packing structure. FIG. 12 is an end view of a packing structure.

As shown in FIGS. 11 and 12, a packing structure 50 includes a first packaging bag 51 and a second packaging bag 52 in this embodiment.

The first packaging bag 51 has a bag opening 53 that opens upward. To be specific, the first packaging bag 51 has a front sheet part 54 and a rear sheet part 55. The front sheet part 54 and the rear sheet part 55 constitute a packaging bag body 56 of the first packaging bag 51. The front sheet part 54 and the rear sheet part 55 are connected by welding at the lower end of the packaging bag body 56. As shown in FIG. 12, the front sheet part 54 has an upper end 54a. The rear sheet part 55 has an upper end 55a. The rear sheet part 55 extends more upward than the upper end 54a of the front sheet part 54 and has an upper extension 55b, which is the extended part. A male zipper profile part 57 having a male engaging surface 57a is formed on an inner surface 55c of the upper extension 55b.

Likewise, the second packaging bag 52 has a bag opening 60 that opens upward. To be specific, the second packaging bag 52 has a front sheet part 61 and a rear sheet part 62. The front sheet part 61 and a rear sheet part 62 constitute a packaging bag body 63 of the second packaging bag 52. The front sheet part 61 and a rear sheet part 62 are connected by welding at the lower end of the packaging bag body 63. The front sheet part 61 has an upper end 61a. The rear sheet part 62 has an upper end 62a. The rear sheet part 62 extends more upward than the upper end 61a of the front sheet part 61 and has an upper extension 62b, which is the extended part. A female zipper profile part 64 having a female engaging surface 64a is formed on an inner surface 62c of the upper extension 62b.

The first packaging bag 51 and the second packaging bag 52 are connected by welding at the lower end of the packing structure 50. The first packaging bag 51 and the second packaging bag 52 may be formed separately and then joined by welding, or the first packaging bag 51 and the second packaging bag 52 may be formed simultaneously by blocking in the internal space of one cylindrical packaging bag by welding at the center in the longitudinal direction.

A method of using the packing structure 50 is as follows. As shown in FIG. 11, an SD memory card 70 is inserted into the first packaging bag 51 through the bag opening 53 of the first packaging bag 51, and an instruction manual 71 is inserted into the second packaging bag 52 through the bag opening 60 of the second packaging bag 52. Then, by engaging the male zipper profile part 57 of the first packaging bag 51 and the female zipper profile part 64 of the second packaging bag 52 with each other, the bag opening 53 of the first packaging bag 51 and the bag opening 60 of the second packaging bag 52 are closed at the same time.

When map data is updated, an operator first pulls the female zipper profile part 64 of the second packaging bag 52 out of the male zipper profile part 57 of the first packaging bag 51 and thereby opens the bag opening 53 and the bag opening 60 at the same time.

Next, the operator takes the SD memory card 70 out of the first packaging bag 51, and rewrites the map data stored in the SD memory card 70 or replaces it with the SD memory card 70 in which new map data is stored. Then, the operator packs the written or new SD memory card 70 into the first packaging bag 51, engages the male zipper profile part 57 of the first packaging bag 51 and the female zipper profile part 64 of the second packaging bag 52 with each other again, thereby closing the bag opening 53 of the first packaging bag 51 and the bag opening 60 of the second packaging bag 52 at the same time.

In this structure, because the first packaging bag 51 and the second packaging bag 52 are joined at all times at the lower end of the packing structure 50, the first packaging bag 51 is not lost in any case. Further, this is convenient because the bag opening 53 of the first packaging bag 51 and the bag opening 60 of the second packaging bag 52 can be closed at the same time simply by engaging the male zipper profile part 57 and the female zipper profile part 64 with each other.

While the invention has been described in terms of several embodiments, those skilled in the art will recognize that the invention can be practiced with various modifications within the spirit and scope of the appended claims and the invention is not limited to the examples described above.

Further, the scope of the claims is not limited by the embodiments described above.

Furthermore, it is noted that, Applicant's intent is to encompass equivalents of all claim elements, even if amended later during prosecution.

What is claimed is:

1. A packaging bag comprising:

a packaging bag body having a bag opening;

an exposed zipper profile part having a male or female engaging surface, the engaging surface being exposed outside when the bag opening is closed, wherein a male zipper profile part having a male engaging surface and a female zipper profile part having a female engaging surface are disposed opposite to each other on an inner surface of the bag opening of the packaging bag body, the bag opening is closed by engaging the male zipper profile part and the female zipper profile part with each other, and the exposed zipper profile part is a part of the male zipper profile part.

2. The packaging bag according to claim 1, wherein the female zipper profile part is formed not to overlap the exposed zipper profile part in a thickness direction of the packaging bag body, and a part of the packaging bag body opposite to the exposed zipper profile part in the thickness direction of the packaging bag body has an opening or cutout.

3. A packaging bag comprising:

a packaging bag body having a bag opening;

an exposed zipper profile part having a male or female engaging surface, the engaging surface being exposed outside when the bag opening is closed, wherein a male zipper profile part having a male engaging surface and a female zipper profile part having a female engaging surface are disposed opposite to each other on an inner surface of the bag opening of the packaging bag body, the bag opening is closed by engaging the male zipper profile part and the female zipper profile part with each other, and the exposed zipper profile part is a part of the female zipper profile part.

4. The packaging bag according to claim 3, wherein the male zipper profile part is formed not to overlap the exposed zipper profile part in a thickness direction of the packaging bag body, and a part of the packaging bag body opposite to the exposed zipper profile part in the thickness direction of the packaging bag body has an opening or cutout.

* * * * *